US007811141B2

(12) United States Patent
Fukuoka

(10) Patent No.: US 7,811,141 B2
(45) Date of Patent: Oct. 12, 2010

(54) BOAT PROPULSION UNIT

(75) Inventor: Yoshihito Fukuoka, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 4 days.

(21) Appl. No.: 12/372,810

(22) Filed: Feb. 18, 2009

(65) Prior Publication Data

US 2009/0209148 A1 Aug. 20, 2009

(30) Foreign Application Priority Data

Feb. 20, 2008 (JP) ..... 2008-038443

(51) Int. Cl.
*B63H 20/14* (2006.01)

(52) U.S. Cl. ..... 440/75

(58) Field of Classification Search ..... 440/75
See application file for complete search history.

(56) References Cited

U.S. PATENT DOCUMENTS 4,400,163 A * 8/1983 Blanchard ..... 440/75
5,888,108 A 3/1999 Iriono
7,458,867 B2 * 12/2008 Matsuda et al. ..... 440/75

FOREIGN PATENT DOCUMENTS

JP 09-263294 A 10/1997

* cited by examiner

*Primary Examiner*—Stephen Avila
(74) *Attorney, Agent, or Firm*—Keating & Bennett, LLP

(57) ABSTRACT

An outboard motor includes a variable speed mechanism portion arranged to transmit a driving force to propellers such that the driving force is changed in its speed by a low reduction ratio and a high reduction ratio, an upper housing that houses the variable speed mechanism portion, oil tanks provided on the outside of the upper housing and arranged to retain oil to be supplied to the upper housing, and an oil lubrication route arranged to supply oil in the oil tanks to the upper housing and to collect the oil supplied in the upper housing in the oil tanks. The above arrangement provides a boat propulsion unit capable of allowing both a performance of acceleration and a maximum speed to approach a level desired by a user and to prevent the occurrence of a loss of the driving energy of an engine.

14 Claims, 6 Drawing Sheets

BOAT PROPULSION UNIT

BACKGROUND OF THE INVENTION

1. Field of the Invention

The present invention relates to a boat propulsion unit. More specifically, the present invention relates to a boat propulsion unit having an engine.

2. Description of the Related Art

Conventionally, a boat propulsion machine having an engine (boat propulsion unit) is known (for example, see JP-A-Hei 9-263294). JP-A-Hei 9-263294 discloses a boat propulsion machine having an engine and a power transmission mechanism for transmitting the driving power of the engine to a propeller by a specified fixed reduction ratio. This boat propulsion machine transmits the driving power of the engine directly to the propeller through the power transmission mechanism, and the propeller speed increases in proportion with an increase in the engine speed.

However, in the boat propulsion machine (boat propulsion unit) disclosed in JP-A-Hei 9-263294, when the reduction ratio of the power transmission mechanism is configured so that the maximum speed becomes large, it is difficult to improve the acceleration performance at a low speed. Conversely, when the reduction ratio of the power transmission mechanism is configured so that the acceleration performance at a low speed is improved, it is difficult to increase the maximum speed. That is, in the boat propulsion machine disclosed in the JP-A-Hei 9-263294, it is difficult to achieve both a performance of the acceleration and the maximum speed to approach a level desired by a user.

In order to solve such an inconvenience, generally, a boat propulsion unit including a power transmission mechanism having a variable speed mechanism portion is desired.

However, the boat propulsion unit having the above-described variable speed mechanism portion generally operates in a state where a gear and the like of the variable speed mechanism portion are soaked in oil for lubricating the variable speed mechanism portion. Consequently, the gear is prevented from rotating due to viscosity of the oil and the like, so that there is a problem that the loss of the driving energy of the engine occurs.

SUMMARY OF THE INVENTION

In order to overcome the problems described above, preferred embodiments of the present invention provide a boat propulsion unit arranged to allow a performance of both the acceleration and the maximum speed to approach a level desired by a user and to inhibit the occurrence of the loss of the driving energy of the engine.

In order to achieve this, a boat propulsion unit according to a preferred embodiment of the present invention includes an engine, a propeller driven by the engine, a variable speed mechanism portion arranged to transmit a driving force generated by the engine to the propeller such that the driving force has its speed changed by at least a low reduction ratio and a high reduction ratio, a first housing arranged to house the variable speed mechanism portion, an oil tank provided on the outside of the first housing and arranged to retain oil to be supplied to the first housing, and an oil lubrication route arranged to supply oil in the oil tank to the first housing and collecting the oil supplied to the first housing in the oil tank.

As described above, the boat propulsion unit according to this preferred embodiment provides a variable speed mechanism portion arranged to transmit a driving force generated by an engine to a propeller such that the driving force has its speed changed by at least a low reduction ratio and a high reduction ratio. In this way, by configuring the variable speed mechanism portion so that it can transmit the driving force generated by the engine to the propeller such that the driving force has its speed changed by a low reduction ratio, the acceleration performance at a low speed can be improved. Moreover, by configuring the variable speed mechanism portion so that it can transmit the driving force generated by the engine to the propeller such that the driving force has its speed changed by a high reduction ratio, the maximum speed can be increased. As a result, it is possible to provide both the performance of acceleration and maximum speed to approach a level desired by a user. Moreover, an oil tank provided on the outside of the first housing arranged to retain oil to be supplied to the first housing and an oil lubrication route arranged to supply oil in the oil tank to the first housing and collecting the oil supplied to the first housing in the oil tank are provided. In this way, by collecting the oil supplied to the first housing in the oil tank provided on the outside of the first housing, oil retention in the first housing can be prevented. This prevents the variable speed mechanism portion in the first housing from being soaked in the oil, thereby preventing the gear and the like of the variable speed mechanism portion from being driven while soaked in the oil. As a result, an occurance of the gear being prevented from rotating due to viscosity of the oil and the like can be prevented, so that a loss of the driving energy of the engine can be minimized.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Hereinafter, preferred embodiments of the present invention will be explained with reference to the drawings.

First Preferred Embodiment

Figure 1:
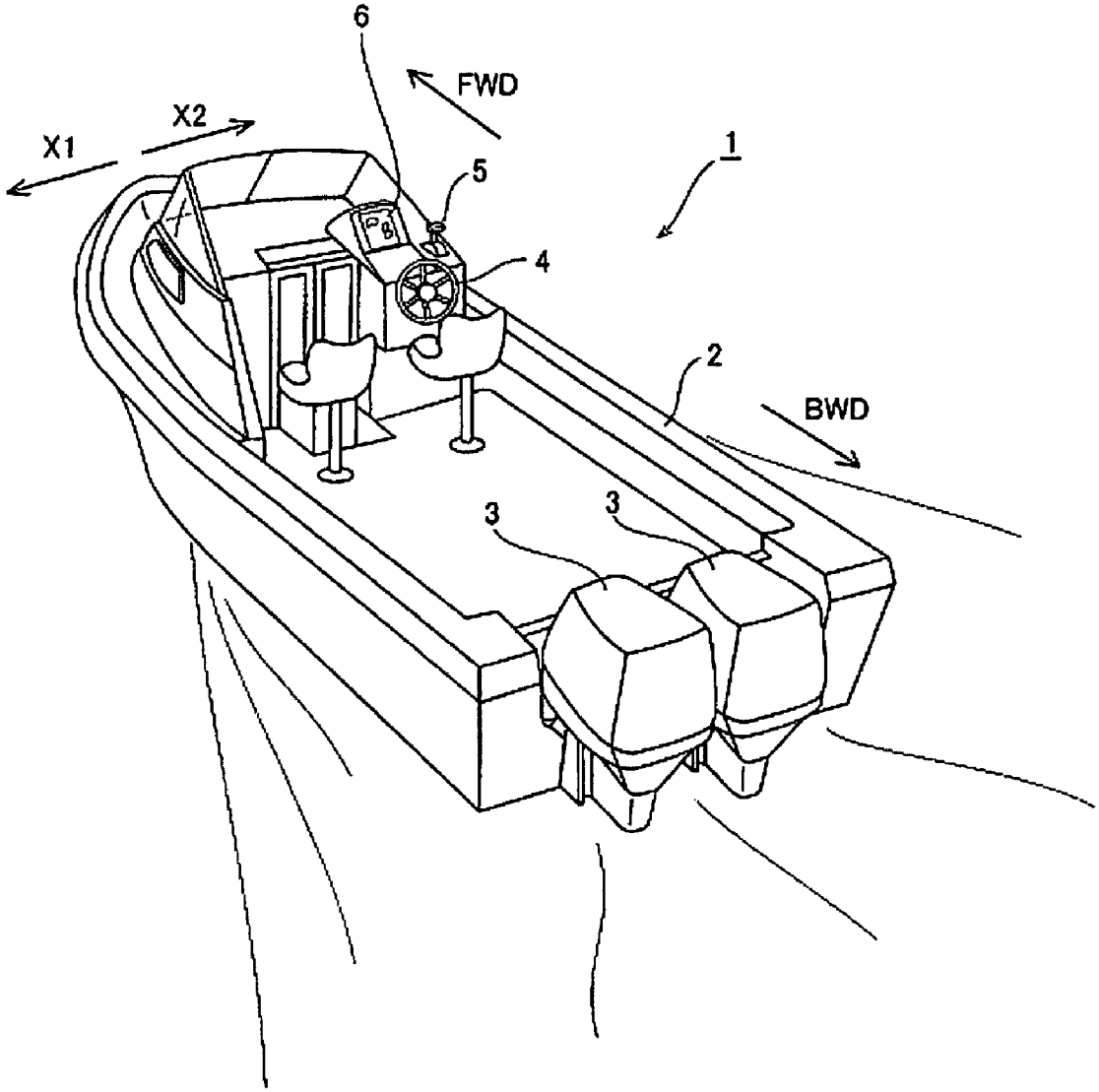
FIG. 1 is a perspective view showing a boat on which an outboard motor according to a first preferred embodiment of the present invention is mounted.
Figure 2:
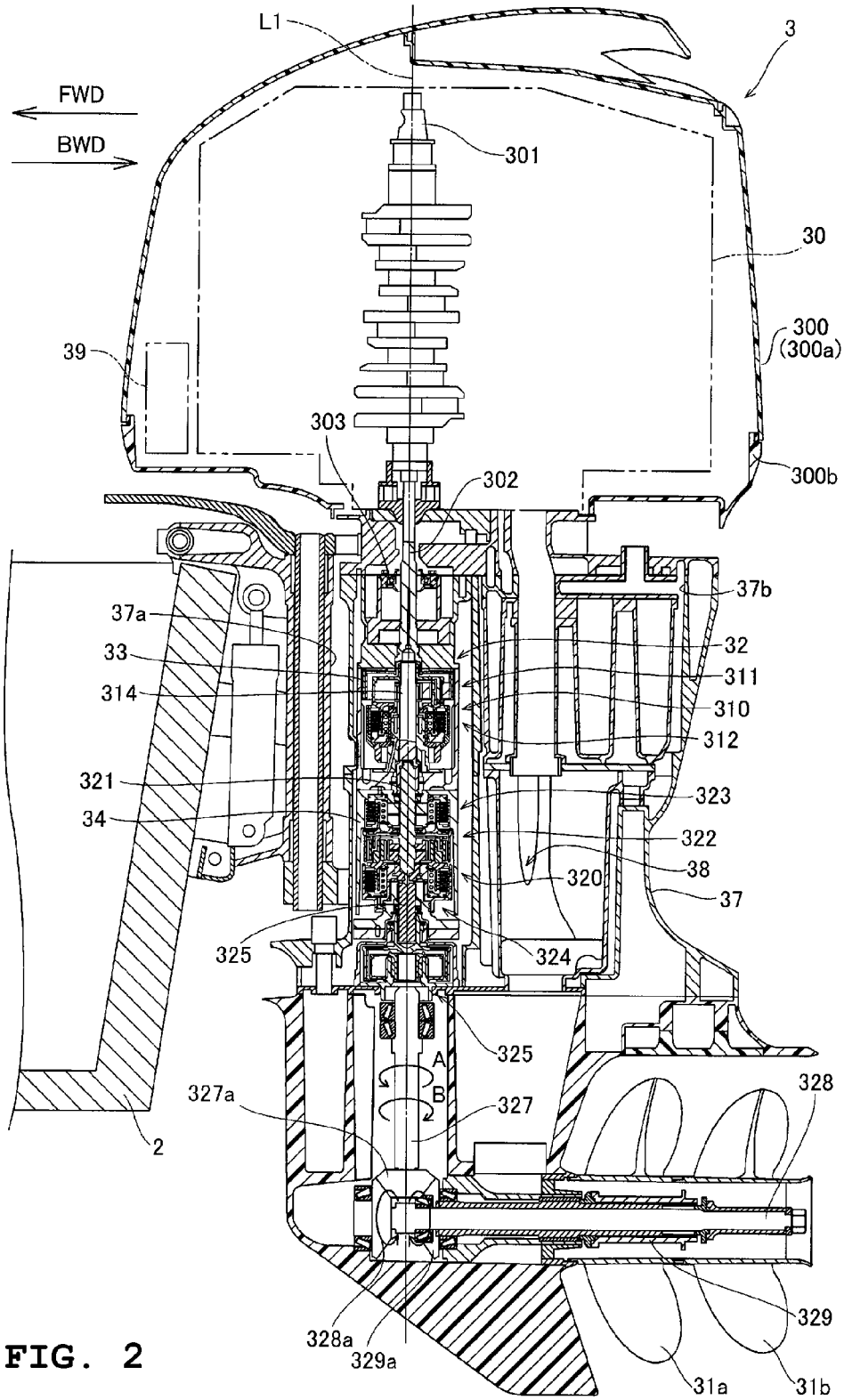
FIG. 2 is a cross-sectional view explaining the configuration of the outboard motor according to the first preferred embodiment shown in FIG. 1.
Figure 3:
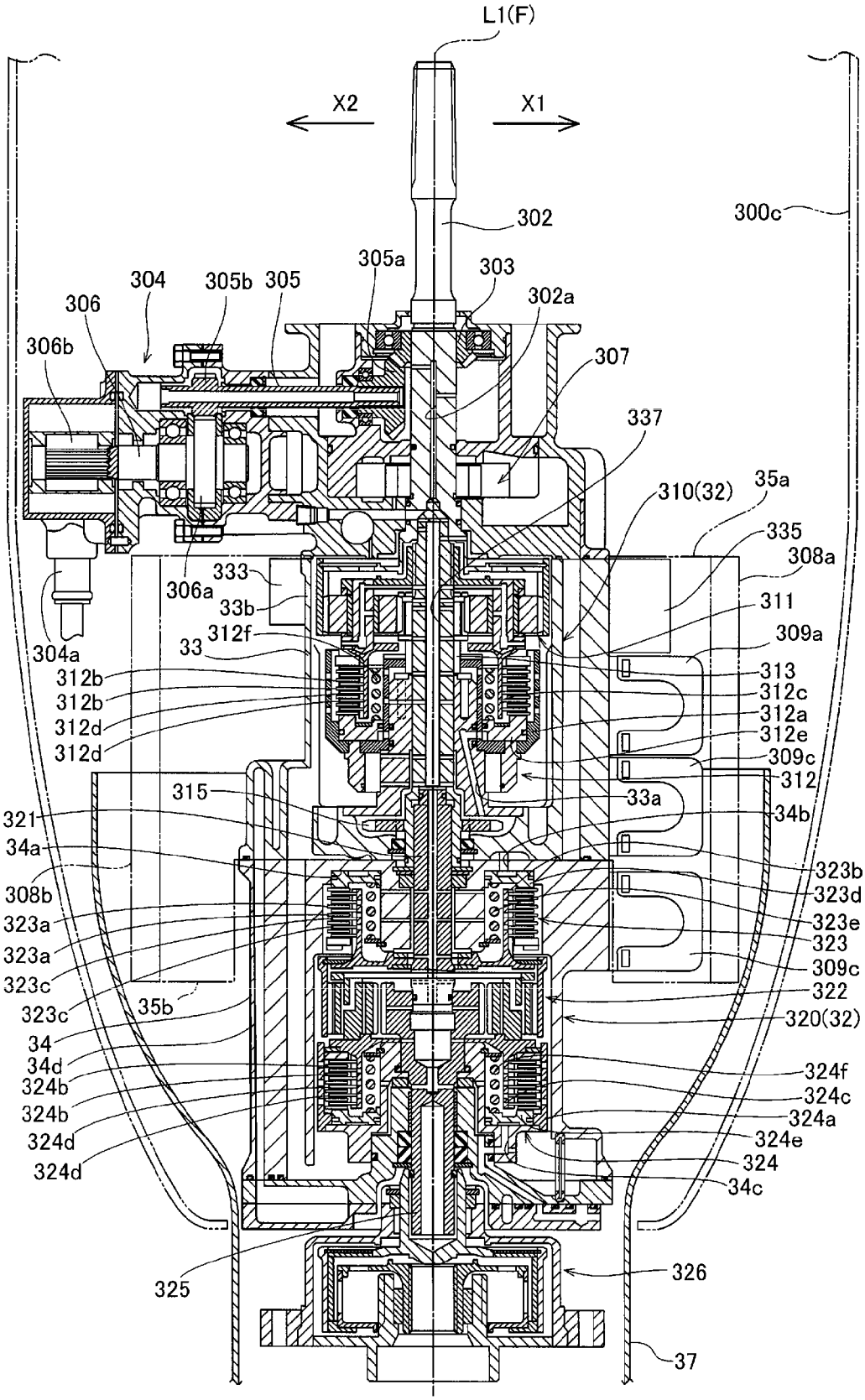
FIG. 3 is a cross-sectional view explaining the configuration of the outboard motor according to the first preferred embodiment shown in FIG. 1.
Figure 4:
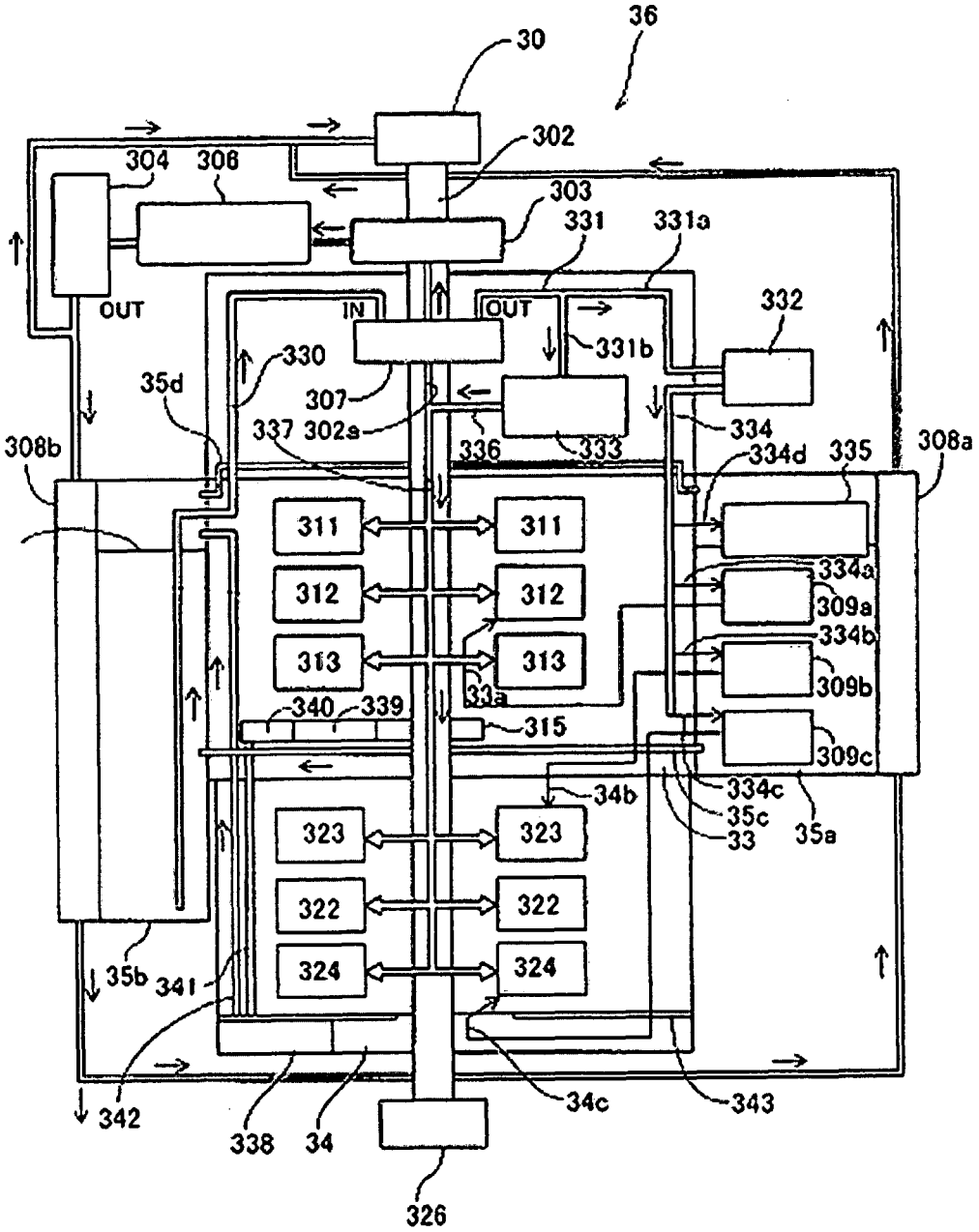
FIG. 4 is a drawing explaining the configuration of an oil lubrication route of the outboard motor according to the first preferred embodiment shown in FIG. 1.

FIG. 1 is a perspective view showing a boat on which an outboard motor according to the first preferred embodiment of the present invention is mounted. FIGS. 2 through 4 are drawings providing a detailed explanation of the outboard motor according to the first preferred embodiment shown in FIG. 1. In the figures, the "FWD" direction indicates the forward direction of the boat, and the "BWD" direction indicates the backward direction of the boat. Initially, with reference to FIGS. 1 through 4, the configuration of an outboard motor 3 mounted on a boat 1 according to the first preferred embodiment will be explained.

As shown in FIG. 1, the boat 1 according to the first preferred embodiment includes a hull 2 preferably floating on the water, two outboard motors 3 mounted on a rear portion of the hull 2 and arranged to drive the hull 2, a steering portion 4 arranged to steer of the hull 2, a control lever portion 5 which is provided adjacent to the steering portion 4 and capable of driving the hull 2 in the forward/reverse direction, and a display portion 6 disposed adjacent to the control lever portion 5. It should be noted that the outboard motor 3 is an example of "a boat propulsion unit."

The two outboard motors 3 are symmetrically disposed about the center of the hull 2 in its width direction (the direction of the arrows X1 and X2). Moreover, as shown in FIG. 2, the outboard motor 3 preferably includes two propellers 31*a* and 31*b* arranged to convert the driving force of an engine 30 into thrust of the boat 1 (see FIG. 4) and a variable speed mechanism portion 32 arranged to transmit the driving force generated by the engine 30 to the propellers 31*a* and 31*b* when the driving force is changed in its speed by a low reduction ratio (approximately 1.33:1.00) and a high reduction ratio (approximately 1.0:1.0). Moreover, the outboard motor 3 includes an upper housing 33 and a lower housing 34 arranged to house the variable speed mechanism portion 32, a pair of oil tanks 35*a* and 35*b* that retain oil to be supplied to the upper housing 33 and the lower housing 34, etc. (see FIG. 3), and an oil lubrication route 36 that supplies the oil retained in the pair of oil tanks 35*a* and 35*b* to the upper housing 33 and the lower housing 34, etc. and collects the oil supplied to the upper housing 33 and the lower housing 34, etc. in the oil tanks 35*a* and 35*b* (see FIG. 4). It should be noted that the upper housing 33 is an example of "a first housing" according to a preferred embodiment of the present invention, and the lower housing 34 is an example of "a second housing" according to a preferred embodiment of the present invention. As shown in FIG. 3, the upper housing 33 and the lower housing 34 are preferably disposed adjacent to each other in the vertical direction. In addition, the oil lubrication route 36 will be explained below in detail.

The upper housing 33, the lower housing 34, the pair of oil tanks 35*a* and 35*b*, and the oil lubrication route 36 are housed in a front side housing portion 37*a* of an upper case 37 (see FIG. 2). It should be noted that the upper case 37 is an example of "a case portion" according to a preferred embodiment of the present invention. Moreover, as shown in FIG. 2, an exhaust expanding chamber 38 arranged to distribute exhaust gas discharged from the engine 30 is housed in a rear side housing portion 37*b* of the upper case 37. In addition, as shown in FIG. 3, the outboard motor 3 is covered by a case portion 300. As shown in FIG. 2, this case portion 300 is defined by an upper cover 300*a* and a lower cover 300*b* disposed to cover the engine 30 and a side cover 300*c* disposed to cover the lateral side and the rear side of the upper case 37 (see FIG. 3). The case portion 300 is preferably made of resin and has a function of protecting an inner portion of the outboard motor 3 from the water and the like.

An ECU (Engine Control Unit) 39 arranged to control the rotation speed of the engine 30 and the gear shift timing of the variable speed mechanism portion 32 and the like is provided in the outboard motor 3. The ECU 39 has a function of electrically controlling an electronic throttle (not shown) of the engine 30 and solenoid valves 309*a*, 309*b*, and 309*c* of the veriable speed mechanism portion 32 described below, etc. when the control lever portion 5 is operated by an operator.

Next, the configurations of the engine 30 and the variable speed mechanism portion 32, etc. will be explained. The engine 30 includes a crankshaft 301 that rotates about an axis line L1. The engine 30 is configured so that the driving force is generated by rotating the crankshaft 301. Moreover, an upper portion of a drive shaft 302 is connected with the crankshaft 301. The drive shaft 302 is disposed on the axis line L1 and is configured to rotate about the axis line L1 in accordance with the rotation of the crankshaft 301. It should be noted that the axis line L1 is an example of "an axis of the drive shaft" according to a preferred embodiment of the present invention.

As shown in FIG. 3, a bevel gear 303 is mounted on a middle portion of the drive shaft 302. A bevel gear 305*a* that is mounted on one side (on the side of the arrow X1) of a middle shaft 305 of a water pump 304 meshes with the bevel gear 303. In addition, on the other side (on the side of the arrow X2) of the middle shaft 305, a pinion gear 305*b* is mounted, and the pinion gear 305*b* meshes with a spur gear 306*a* mounted on one side (on the side of the arrow X1) of a water pump drive shaft 306. Moreover, an impeller 306*b* is mounted on the other side (on the side of the arrow X2) of the water pump drive shaft 306. As shown in FIG. 4, due to the rotation of the impeller 306*b*, the water pump 304 is configured so that water existing below the water surface on which the boat 1 is floating is suctioned to be supplied to the engine 30 and cooling water distribution tanks 308*a* and 308*b* described below. Additionally, as shown in FIG. 3, a water guiding port 304*a* is provided on the water pump 304, and the water supplied to the cooling water distribution tanks 308*a* and 308*b* is discharged from the water guiding port 304*a*.

An oil pump 307 defined by a trochoid pump is mounted below the bevel gear 303 of the drive shaft 302. It should be noted that the oil pump 307 is an example of "a second oil pump" according to a preferred embodiment of the present invention. The oil pump 307 has a function of suctioning oil retained in the oil tanks 35*a* and 35*b* as well as applying hydraulic pressure to the oil and arranged to supply the suctioned oil to specified portions in the outboard motor 3 (the variable speed mechanism portion 32, and the solenoid valves 309*a*, 309*b*, and 309*c* described below).

A lower portion of the drive shaft 302 is connected with the variable speed mechanism portion 32. The variable speed mechanism portion 32 is defined by an upper variable speed portion 310 that is shifted to enable the boat 1 to move at a high speed or a low speed, and a lower variable speed portion 320 that is shifted to enable the boat 1 to move in the forward or backward direction. It should be noted that the lower variable speed portion 320 is an example of "a shift mechanism portion" according to a preferred embodiment of the present invention.

The upper variable speed portion 310 is housed in the upper housing 33 and includes a planetary gear portion 311 capable of slowing down the driving force of the drive shaft 302, a clutch portion 312 and a one-way clutch 313 that control the rotation of the planetary gear portion 311, a middle shaft 314 to which the driving force of the drive shaft 302 is transmitted through the planetary gear portion 311, and a spur gear 315 mounted on a lower portion of the middle shaft 314. The upper variable speed portion 310 is configured so that the middle shaft 314 rotates without a substantial speed reduction compared to the rotation speed of the drive shaft 302 in a state that the clutch portion 312 is engaged. On the other hand, the upper variable speed portion 310 is configured so that the middle shaft 314 rotates at a reduced rotation speed compared to the rotation speed of the drive shaft 302 due to the rotation of the planetary gear portion 311 in a state that the clutch portion 312 is disengaged. It should be noted that the spur gear 315 is an example of "a gear" according to a preferred embodiment of the present invention.

The clutch portion 312 is preferably defined by a wet-type multiplate clutch. The clutch portion 312 preferably includes an outer case portion 312*a* supported by the one-way clutch 313 for rotation only in the A direction, a plurality of clutch plates 312*b* separately disposed at specified intervals on an inner peripheral portion of the outer case portion 312*a*, an inner case portion 312*c* at least a portion of which is disposed on the inside of the outer case portion 312*a*, and a plurality of clutch plates 312*d* mounted in the inner case portion 312*c* and disposed on each interval between the plurality of clutch plates 312*b*. The clutch portion 312 is configured to be in an engaged state such that the outer case portion 312*a* and the inner case portion 312*c* rotate integrally when the clutch plates 312*b* of the outer case portion 312*a* and the clutch plates 312*d* of the inner case portion 312*c* contact each other. On the other hand, the clutch portion 312 is configured to be in a disengaged state such that the outer case portion 312*a* and the inner case portion 312*c* do not rotate integrally when the clutch plates 312*b* of the outer case portion 312*a* and the clutch plates 312*d* of the inner case portion 312*c* are separated.

More specifically, a piston portion 312*e* that is slidable with respect to an inner peripheral surface of the outer case portion 312*a* is disposed in the outer case portion 312*a*. The piston portion 312*e* is configured to move each of the plural clutch plates 312*b* of the outer case portion 312*a* in the sliding direction of the piston portion 312*e* when the piston portion 312*e* is slid with respect to the inner peripheral surface of the outer case portion 312*a*. Moreover, a compression coil spring 312*f* is disposed in the outer case portion 312*a*. The compression coil spring 312*f* is disposed to urge the piston portion 312*e* in the direction that the clutch plates 312*b* of the outer case portion 312*a* and the clutch plates 312*d* of the inner case portion 312*c* are separated. In addition, the piston portion 312*e* is configured to slide with respect to the inner peripheral surface of the outer case portion 312*a* against the reaction force of the compression coil spring 312*f* when the pressure of the oil flowing in an oil route 33*a* of the upper housing 33 is increased by the solenoid valve 309*a* described below. By increasing or decreasing the pressure of the oil flowing in the oil route 33*a* of the upper housing 33 as described above, the clutch plates 312*b* of the outer case portion 312*a* and the clutch plates 312*d* of the inner case portion 312*c* can be contacted or separated, which enables the engagement or disengagement of the clutch portion 312.

The spur gear 315 is provided to drive an oil pump 338 described below. This spur gear 315 is fixed to the middle shaft 314 and configured to be rotatable in accordance with the rotation of the middle shaft 314 (the drive shaft 302).

The lower variable speed portion 320 is provided below the upper variable speed portion 310 and housed in the lower housing 34. The lower variable speed portion 320 includes a middle transmission shaft 321 connected with the middle shaft 314, a planetary gear portion 322 capable of slowing down the driving force of the middle transmission shaft 321, a forward/reverse switching clutch portion 323 and a forward/reverse switching clutch portion 324 which regulate the rotation of the planetary gear portion 322, and a lower transmission shaft 325 to which the driving force of the middle transmission shaft 321 is transmitted through the planetary gear portion 322. The lower variable speed portion 320 is configured so that the lower transmission shaft 325 rotates in the opposite direction (the B direction) from the rotating direction (the A direction) of the middle shaft 314 (the drive shaft 302) when the forward/reverse switching clutch portion 323 is engaged and the forward/reverse switching clutch portion 324 is disengaged. In such a case, the lower variable speed portion 320 is configured to rotate only the propeller 31*a* without rotating the propeller 31*b* so that the boat 1 moves backward. Meanwhile, the lower variable speed portion 320 is configured so that the lower transmission shaft 325 rotates in the same direction as the rotating direction (the A direction) of the middle shaft 314 (the drive shaft 302) when the forward/reverse switching clutch portion 323 is disengaged and the forward/reverse switching clutch portion 324 is engaged. In such a case, the lower variable speed portion 320 is configured to rotate the propeller 31*a* in the opposite direction from the case of moving the boat 1 backward and rotate the propeller 31*b* in the opposite direction from the propeller 31*a* so that the boat 1 advances. Additionally, the lower variable speed portion 320 is configured to prevent both the forward/reverse switching clutch portion 323 and the forward/reverse switching clutch portion 324 being engaged concurrently. Moreover, the lower variable speed portion 320 is configured so that the rotation of the middle shaft 314 (the drive shaft 302) is not transmitted to the lower transmission shaft 325 (to be in a neutral state) when both the forward/reverse switching clutch portion 323 and the forward/reverse switching clutch portion 324 are disengaged.

The forward/reverse switching clutch portion 323 is provided in an upper portion on the inside of the lower housing 34. The forward/reverse switching clutch portion 323 is preferably defined by a wet-type multiplate clutch, and is partially defined by a recessed portion 34*a* of the lower housing 34. The forward/reverse switching clutch portion 323 is mainly defined by a plurality of clutch plates 323*a* separately disposed at specified intervals in an inner peripheral portion of the recessed portion 34*a*, an inner case portion 323*b* at least part of which is disposed on the inside of the recessed portion 34*a*, and a plurality of clutch plates 323*c* mounted in the inner case portion 323*b* and disposed on each interval between the plurality of clutch plates 323*a*. The forward/reverse switching clutch portion 323 is configured so that the rotation of the inner case portion 323*b* is regulated by the lower housing 34 when the clutch plates 323*a* of the recessed portion 34*a* and the clutch plates 323*c* of the inner case portion 323*b* contact each other. On the other hand, the forward/reverse switching clutch portion 323 is configured so that the inner case portion 323*b* is freely rotatable with respect to the lower housing 34 when the clutch plates 323*a* of the recessed portion 34*a* and the clutch plates 323*c* of the inner case portion 323*b* are separated.

More specifically, a piston portion 323*d* that is slidable with respect to an inner peripheral surface of the recessed portion 34*a* is disposed in the recessed portion 34*a* of the lower housing 34. The piston portion 323*d* is configured to move the clutch plates 323*a* in the recessed portion 34*a* in the sliding direction of the piston portion 323*d* when the piston portion 323*d* is slid with respect to the inner peripheral surface of the recessed portion 34*a*. Moreover, a compression coil spring 323*e* is disposed in the recessed portion 34*a* of the lower housing 34. The compression coil spring 323*e* is disposed to urge the piston portion 323*d* in the direction that the clutch plates 323*a* of the recessed portion 34*a* and the clutch plates 323*c* of the inner case portion 323*b* are separated. In addition, the piston portion 323*d* is configured to slide with respect to the inner peripheral surface of the recessed portion 34*a* against the reaction force of the compression coil spring 323*e* when the pressure of the oil flowing in an oil route 34*b* of the lower housing 34 is increased by the solenoid valve 309*b* described below. By increasing or decreasing the pressure of the oil flowing in the oil route 34*b* of the lower housing 34 as described above, the forward/reverse switching clutch portion 323 can be engaged or disengaged.

The forward/reverse switching clutch portion 324 is provided in a lower portion on the inside of the lower housing 34, and is preferably defined by a wet-type multiplate clutch. The forward/reverse switching clutch portion 324 is mainly defined by an outer case portion 324*a*, a plurality of clutch plates 324*b* separately disposed at specified intervals in an inner peripheral portion of the outer case portion 324*a*, an inner case portion 324*c* at least a portion of which is disposed on the inside of the outer case portion 324*a*, and a plurality of clutch plates 324*d* mounted in the inner case portion 324*c* and disposed on each interval between the plurality of clutch plates 324*b*. The forward/reverse switching clutch portion 324 is configured so that the inner case portion 324*c* and the outer case portion 324*a* integrally rotate about the axis line L1 when the clutch plates 324*b* of the outer case portion 324*a* and the clutch plates 324*d* of the inner case portion 324*c* contact each other. Meanwhile, the forward/reverse switching clutch portion 324 is configured so that the inner case portion 324*c* is freely rotatable with respect to the outer case portion 324*a* when the clutch plates 324*b* of the outer case portion 324*a* and the clutch plates 324*d* of the inner case portion 324*c* are separated.

More specifically, a piston portion 324*e* that is slidable with respect to an inner peripheral surface of the outer case portion 324*a* is disposed in the outer case portion 324*a*. The piston portion 324*e* is configured to move the plurality of clutch plates 324*b* in the outer case portion 324*a* in the sliding direction of the piston portion 324*e* when the piston portion 324*e* is slid with respect to the inner peripheral surface of the outer case portion 324*a*. Moreover, a compression coil spring 324*f* is disposed in the outer case portion 324*a*. The compression coil spring 324*f* is disposed to urge the piston portion 324*e* in the direction that the clutch plates 324*b* of the outer case portion 324*a* and the clutch plates 324*d* of the inner case portion 324*c* are separated. In addition, the piston portion 324*e* is configured to slide with respect to the inner peripheral surface of the outer case portion 324*a* against the reaction force of the compression coil spring 324*f* when the pressure of the oil flowing in an oil route 34*c* of the lower housing 34 is increased by the solenoid valve 309*c* described below. By increasing or decreasing the pressure of the oil flowing in the oil route 34*c* of the lower housing 34 as described above, the forward/reverse switching clutch portion 324 can be engaged or disengaged.

As shown in FIG. 2, a speed reducer 326 is provided below the variable speed mechanism portion 32. The lower transmission shaft 325 of the variable speed mechanism portion 32 enters the speed reducer 326, and the speed reducer 326 has a function of slowing down the driving force inputted by the lower transmission shaft 325. Moreover, a vertical propeller shaft 327 is provided below the speed reducer 326. The vertical propeller shaft 327 is configured to rotate in the same direction as the lower transmission shaft 325, and a bevel gear 327*a* is provided below the vertical propeller shaft 327.

A bevel gear 328*a* of an inner propeller shaft 328 and a bevel gear 329*a* of an outer propeller shaft 329 mesh with the bevel gear 327*a* of the vertical propeller shaft 327. The inner propeller shaft 328 is disposed to extend rearward (in the arrow "BWD" direction), and the above-described propeller 31*b* is mounted on the side of the arrow "BWD" direction of the inner propeller shaft 328. Moreover, the outer propeller shaft 329 is also disposed to extend in the arrow "BWD" direction similarly to the inner propeller shaft 328, and the above-described propeller 31*a* is mounted on the side of the arrow "BWD" direction of the outer propeller shaft 329. Moreover, the outer propeller shaft 329 preferably is hollow, and the inner propeller shaft 328 is inserted in the hollow portion of the outer propeller shaft 329. In addition, the inner propeller shaft 328 and the outer propeller shaft 329 are configured to rotate independently.

The bevel gear 328*a* meshes with a portion on the side of the arrow "FWD" direction of the bevel gear 327*a*, and the bevel gear 329*a* meshes with a portion on the side of the arrow "BWD" direction of the bevel gear 327*a*. This allows the inner propeller shaft 328 and the outer propeller shaft 329 to rotate in the different directions from each other when the bevel gear 328*a* is rotated.

Here, as shown in FIG. 3, in the first preferred embodiment, the pair of oil tanks 35*a* and 35*b* are mounted on an outer wall 33*b* of the upper housing 33. Each of the paired oil tanks 35*a* and 35*b* is separate from the upper housing 33 and mounted on the outside of the upper housing 33. In addition, the pair of oil tanks 35*a* and 35*b* are separately disposed on both right and left (two) areas separated by a plane F that includes the axis line L1 which is coaxial or substantially coaxial with the axis of the drive shaft 302 and extends in the moving direction of the boat 1 (the arrow "FWD" direction and the arrow "BWD" direction in FIG. 1). More specifically, the oil tank 35*a* is disposed on the left side of the upper housing 33 (in the direction of the arrow X1) and the oil tank 35*b* is disposed on the right side of the upper housing 33 (in the direction of the arrow X2).

As shown in FIG. 4, in the first preferred embodiment, a tank communication route 35*c* is provided between a lower portion of the oil tank 35*a* and a lower portion of the oil tank 35*b*. It should be noted that the tank communication route 35*c* is an example of "an oil communication route" according to a preferred embodiment of the present invention. The tank communication route 35*c* connects the pair of oil tanks 35*a* and 35*b* and allows the oil retained in each of the oil tanks 35*a* and 35*b* to communicate with each other.

In the first preferred embodiment, an air communication route 35*d* is provided between an upper portion of the oil tank 35*a* and an upper portion of the oil tank 35*b*. It should be noted that the air communication route 35*d* is an example of "an air communication route" according to a preferred embodiment of the present invention. The air communication route 35*d* connects the pair of oil tanks 35*a* and 35*b* and allows the air in each of the oil tanks 35*a* and 35*b* to communicate with each other.

As shown in FIG. 3, in the first preferred embodiment, a pair of cooling water distribution tanks 308*a* and 308*b* are disposed on the side portions of the oil tanks 35*a* and 35*b*. The cooling water distribution tanks 308*a* and 308*b* are respectively disposed on the oil tanks 35*a* and 35*b* to cover three sides thereof in the U-letter shape. In addition, the cooling water distribution tanks 308*a* and 308*b* are connected with the water guiding port 304*a* of the water pump 304, and configured to allow the water discharged from the water pump 304 to be distributed. Moreover, the pair of cooling water distribution tanks 308*a* and 308*b* are respectively provided to cool the oil retained in the oil tanks 35*a* and 35*b*.

In the first preferred embodiment, the solenoid valves 309*a*, 309*b*, and 309*c* are preferably disposed in an inner portion of the oil tank 35*a*. It should be noted that the solenoid valves 309*a*, 309*b*, and 309*c* are examples of "an electromagnetic valve" according to a preferred embodiment of the present invention. The solenoid valves 309*a* and 309*b* are preferably mounted on the outer wall 33*b* of the upper housing 33, and the solenoid valve 309*c* is mounted on an outer wall 34*d* of the lower housing 34. The solenoid valve 309*a* is connected with the oil route 33*a* disposed below the piston portion 312*e* of the clutch portion 312. That is, the solenoid valve 309*a* is provided to operate the clutch portion 312. In addition, the solenoid valve 309*b* is connected with the oil route 34*b* provided above the piston portion 323*d* of the forward/reverse switching clutch portion 323. That is, the solenoid valve 309*b* is provided to operate the forward/reverse switching clutch portion 323. Moreover, the solenoid valve 309*c* is connected with the oil route 34*c* provided below the piston portion 324*e* of the forward/reverse switching clutch portion 324. That is, the solenoid valve 309*c* is provided to operate the forward/reverse switching clutch portion 324.

Next, the configuration of the oil lubrication route 36 will be explained in detail. The oil lubrication route 36 includes a route in which oil retained in the pair of oil tanks 35*a* and 35*b* flows into the oil pump 307 and then the oil is supplied to the upper housing 33 and the lower housing 34 as well as to the solenoid valves 309*a*, 309*b*, and 309*c*. The oil lubrication route 36 also includes a route arranged to return the oil supplied to the upper housing 33 and the lower housing 34 to the pair of oil tanks 35*a* and 35*b*.

Next, a description will be made in detail of the configuration of the route in which the oil is distributed from the pair of oil tanks 35*a* and 35*b* to the upper housing 33 and the lower housing 34 as well as to the solenoid valves 309*a*, 309*b*, and 309*c* through the oil pump 307.

One side of an oil route 330 is disposed in an inner portion of the oil tank 35*b*. Meanwhile, the other side of the oil route 330 is connected with the oil pump 307. The oil route 330 is provided to allow the oil retained in the oil tank 35*b* (oil tank 35*a*) to flow into the oil pump 307.

One side of an oil route 331 arranged to guide the oil flowing from the oil tank 35*b* (and oil tank 35*a*) is connected with the oil pump 307. The other side of the oil route 331 is divided into two routes, which are a solenoid side route 331*a* and a housing side route 331*b*. The solenoid side route 331*a* is connected with a filter 332, and the housing side route 331*b* is connected with a low-pressure relief valve 333. It should be noted that the low-pressure relief valve 333 is an example of "a relief valve" according to a preferred embodiment of the present invention.

The filter 332 has a function of filtering waste, dust, etc. in the oil flowing to the solenoid valves 309*a*, 309*b*, and 309*c*. The filter 332 also has a function of preventing the pressure of the oil guided from the oil pump 307 from increasing.

One side of the oil route 334 that guides the oil flowing from the solenoid side route 331*a* is connected with the filter 332. The other side of the oil route 334 is divided into a first solenoid route 334*a* connected with the solenoid valve 309*a*, a second solenoid route 334*b* connected with the solenoid valve 309*b*, a third solenoid route 334*c* connected with the solenoid valve 309*c*, and a relief valve route 334*d* connected with a high-pressure relief valve 335. The high-pressure relief valve 335 has a function of discharging oil flowing in the oil route 334 from the oil route 334 when the pressure of the oil flowing in the oil route 334 increases to approximately 12 MPa or more. This inhibits the inner pressure of the oil route 334 from increasing to exceed the specified inner pressure. As a result, the application of excessive oil pressure to the solenoid valves 309*a*, 309*b*, and 309*c* is prevented, which inhibits breakage of the solenoid valves 309*a*, 309*b*, and 309*c*. Additionally, the oil discharged from the high-pressure relief valve 335 is discarded in the oil tank 35*a*.

One side of the oil route 336 arranged to guide the oil flowing from the housing side route 331*b* is connected with the low-pressure relief valve 333. The oil flowing in the housing side route 331*b* from the low-pressure relief valve 333 is guided to the oil route 336 when the pressure of the oil flowing in the housing side route 331*b* of the oil route 331 increases to approximately 5 MPa or more. In other words, the low-pressure relief valve 333 is configured so that it does not guide the oil to the housing side route 331*b* when the pressure of the oil flowing in the housing side route 331*b* is smaller than 5 MPa. That is, in the first preferred embodiment, the low-pressure relief valve 333 has a function of cutting off the distribution of the oil supplied to the variable speed mechanism portion 32 and supplying the oil to the solenoid valves 309*a*, 309*b*, and 309*c* when the pressure of the oil flowing in the housing side route 331*b* is decreased to be smaller than about 5 MPa.

In addition, the other side of the oil route 336 is connected with an oil route 302*a* provided on the axis of the drive shaft 302. A lower end of the oil route 302*a* is connected with an oil route 337 provided on the middle shaft 314 (see FIG. 3), the middle transmission shaft 321 (see FIG. 3), and the lower transmission shaft 325 (see FIG. 3), which enables the distribution of the oil guided from the low-pressure relief valve 333. The oil flowing to the oil route 337 is distributed to each portion in the upper housing 33 and the lower housing 34 to lubricate each portion in the upper housing 33 and the lower housing 34. Additionally, the oil used for lubrication of each portion in the upper housing 33 and the lower housing 34 runs down into a lower portion of the lower housing 34.

Moreover, an upper portion of the oil route 302*a* of the drive shaft 302 is guided to a portion adjacent to the bevel gear 303 of the water pump 304. The oil guided from the low-pressure relief valve 333 is guided from an upper portion of the oil route 302*a* to lubricate each portion of the water pump 304.

Next, a description will be made in detail of the configuration of the oil lubrication route 36 arranged to return the oil that has been supplied to the upper housing 33 and the lower housing 34 as well as the solenoid valves 309*a*, 309*b*, and 309*c* into the pair of oil tanks 35*a* and 35*b* through the oil pump 338.

The oil pump 338 that suctions the oil retained in the lower portion of the lower housing 34 after lubricating each portion in the upper housing 33 and the lower housing 34 is provided on the lower portion in the lower housing 34. It should be noted that the oil pump 338 is an example of "a first oil pump" according to a preferred embodiment of the present invention. The oil pump 338 is configured to operate in accordance with the rotation of the spur gear 315 (middle shaft 314) as described above. More specifically, the spur gear 315 meshes with a middle gear 339 and a pump drive gear 340 meshes with the middle gear 339. One side of a pump drive shaft 341 is mounted to the pump drive gear 340, and the other side of the pump drive shaft 341 is inserted in the oil pump 338. Additionally, a trochoid gear (not shown) is mounted on the other side of the pump drive shaft 341. That is, the oil pump 338 is preferably defined by a trochoid pump.

One side of the oil route 342 is connected with the oil pump 338. The oil route 342 is provided to guide the oil retained in the lower portion of the lower housing 34 through the oil pump 338. Meanwhile, the other side of the oil route 342 is connected with an upper portion of the oil tank 35*b*, so that the oil guided by the oil pump 338 is collected in the oil tank 35*b* (oil tank 35*a*). Additionally, a baffle plate 343 arranged to inhibit the oil from splashing upward is provided in the lower portion of the lower housing 34.

As described above, in the first preferred embodiment, the variable speed mechanism portion 32 arranged to transmit a driving force generated by the engine 30 to the propellers 31*a* and 31*b* when the speed of the driving force is changed by at least a low reduction ratio and a high reduction ratio is provided. In this way, by configuring the variable speed mechanism portion 32 that it can transmit the driving force generated by the engine 30 to the propellers 31*a* and 31*b* in a state that the speed of the driving force is changed by a low reduction ratio, the acceleration performance at a low speed can be improved. In addition, by configuring the variable speed mechanism portion 32 so that it can transmit the driving force generated by the engine 30 to the propellers 31*a* and 31*b* in a state that the speed of the driving force is changed by a high reduction ratio, the maximum speed can be increased. As a result, it is possible to provide both the performance of acceleration and maximum speed to approach a level desired by the user. Moreover, the oil tanks 35*a* and 35*b* are provided on the outside of the upper housing 33 arranged to retain oil to be supplied to the upper housing 33 and the lower housing 34, and the oil lubrication route 36 arranged to supply oil in the oil tanks 35*a* and 35*b* to the upper housing 33 and the lower housing 34 and collecting the oil supplied to the upper housing 33 and the lower housing 34 in the oil tanks 35*a* and 35*b*. In this way, by collecting the oil supplied to the upper housing 33 and the lower housing 34 in the oil tanks 35*a* and 35*b* provided on the outside of the upper housing 33, oil retention in the lower housing 34 can be inhibited. Accordingly, this ensures that the variable speed mechanism portion 32 in the lower housing 34 is not soaked in the oil, thereby inhibiting that the planetary gear portion 322 and the like of the variable speed mechanism portion 32 is driven while being soaked in the oil. As a result, a loss of driving energy of the engine 30 due to the planetary gear 322 and the like being prevented from rotating due to viscosity of the oil and the like can be inhibited.

As described above, in the first preferred embodiment, the pair of oil tanks 35*a* and 35*b* are preferably disposed on both right and left (two) areas separated by the plane F that includes the axis of the drive shaft 302 (the axis line L1) and extends in the moving direction of the boat 1 (the arrow "FWD" direction and the arrow "BWD" direction). In this way, by disposing the oil tanks 35*a* and 35*b* in the right and left direction in which a larger space can be secured than in the fore-and-aft direction of the drive shaft 302, the outboard motor 3 is prevented from enlarging in the fore-and-aft direction.

As described above, in the first preferred embodiment, the pair of oil tanks 35*a* and 35*b* are separately disposed on right and left sides of the upper housing 33. By doing this, the right and left weight balance of the outboard motor 3 is prevented from becoming disproportionate when compared to a case where the pair of tanks 35*a* and 35*b* are disposed on only one of the right and left sides of the upper housing 33.

As described above, in the first preferred embodiment, the oil lubrication route 36 is configured so that the oil provided in the upper housing 33 and the lower housing 34 is collected in the oil tanks 35*a* and 35*b*. As a result, the oil retention in the upper housing 33 and the lower housing 34 can be inhibited. This inhibits the variable speed mechanism portion 32 in the upper housing 33 and the lower housing 34 from being soaked in the oil. Therefore, it is possible to inhibit the planetary gear portions 311 and 322, etc. of the variable speed mechanism portion 32 from being driven while being soaked in the oil.

As described above, in the first preferred embodiment, the oil tanks 35*a* and 35*b* are mounted on the outer wall 33*b* of the upper housing 33 disposed above the lower housing 34, so that the level of the oil retained in the oil tanks 35*a* and 35*b* becomes high. Consequently, the difference between the level of the oil retained in the oil tanks 35*a* and 35*b* and the disposed position of the oil pump 307 becomes small, so that the oil is sufficiently suctioned from the oil tanks 35*a* and 35*b* even when the output of the oil pump 307 is small. As a result, the oil is sufficiently supplied into the upper housing 33 and the lower housing 34 and to the solenoid valves 309*a*, 309*b*, and 309*c*.

As described above, in the first preferred embodiment, the oil pump 338 mounted in the lower housing 34 arranged to collect the oil supplied to the upper housing 33 and the lower housing 34 in the oil tanks 35*a* and 35*b* is provided. Consequently, the oil used for lubrication of inner portions of the upper housing 33 and the lower housing 34 can be easily collected.

As described above, in the first preferred embodiment, the oil pump 338 is configured to be operated in accordance with the rotation of the spur gear 315. Consequently, the oil used for lubrication of the inner portions of the upper housing 33 and the lower housing 34 can be collected by using the power generated by the engine 30.

As described above, in the first preferred embodiment, the solenoid valves 309*a*, 309*b*, and 309*c* are disposed in the oil tanks 35*a* and 35*b*. Consequently, the solenoid valves 309*a*, 309*b*, and 309*c* are cooled by the oil retained in the oil tanks 35*a* and 35*b*.

As described above, in the first preferred embodiment, by providing the oil pump 307 configured to be operated in accordance with the rotation of the drive shaft 302 arranged to supply the oil retained in the oil tanks 35*a* and 35*b* to the variable speed mechanism portion 32 and the solenoid valves 309*a*, 309*b*, and 309*c*, the oil can easily be supplied to both the variable speed mechanism portion 32 and the solenoid valves 309*a*, 309*b*, and 309*c* by using the power generated by the engine 30. Moreover, by providing the low-pressure relief valve 333 that cuts off the distribution of the oil supplied to the variable speed mechanism portion 32 and supplies the oil to the solenoid valves 309*a*, 309*b*, and 309*c* when the output of the oil pump 307 is decreased, the oil can preferentially be supplied to the solenoid valves 309*a*, 309*b*, and 309*c*. This inhibits the solenoid valves 309*a*, 309*b*, and 309*c* from being operated when the output of the oil pump 307 is decreased.

As described above, in the first preferred embodiment, by providing the tank communication route 35*c* that connects the pair of oil tanks 35*a* and 35*b* with each other and allows the oil retained in each of the oil tanks 35*a* and 35*b* to communicate with each other, the oil is prevented from being retained disproportionately in one of the oil tanks 35*a* and 35*b*.

As described above, in the first preferred embodiment, the inner pressures of the oil tanks 35*a* and 35*b* are maintained evenly by providing the air communication route 35*d* that connects upper portions of the paired oil tanks 35*a* and 35*b* with each other. Consequently, the oil is more reliably prevented from being disproportionately retained in one of the oil tanks 35*a* and 35*b*.

As described above, in the first preferred embodiment, by providing the cooling water distribution tanks 308*a* and 308*b* that are disposed to cover the side portions of the oil tanks 35*a* and 35*b* and to allow the cooling water to be distributed, the oil tanks 35*a* and 35*b* are effectively cooled. This allows effective cooling of the oil retained in the oil tanks 35*a* and 35*b*.

Second Preferred Embodiment

Figure 5:
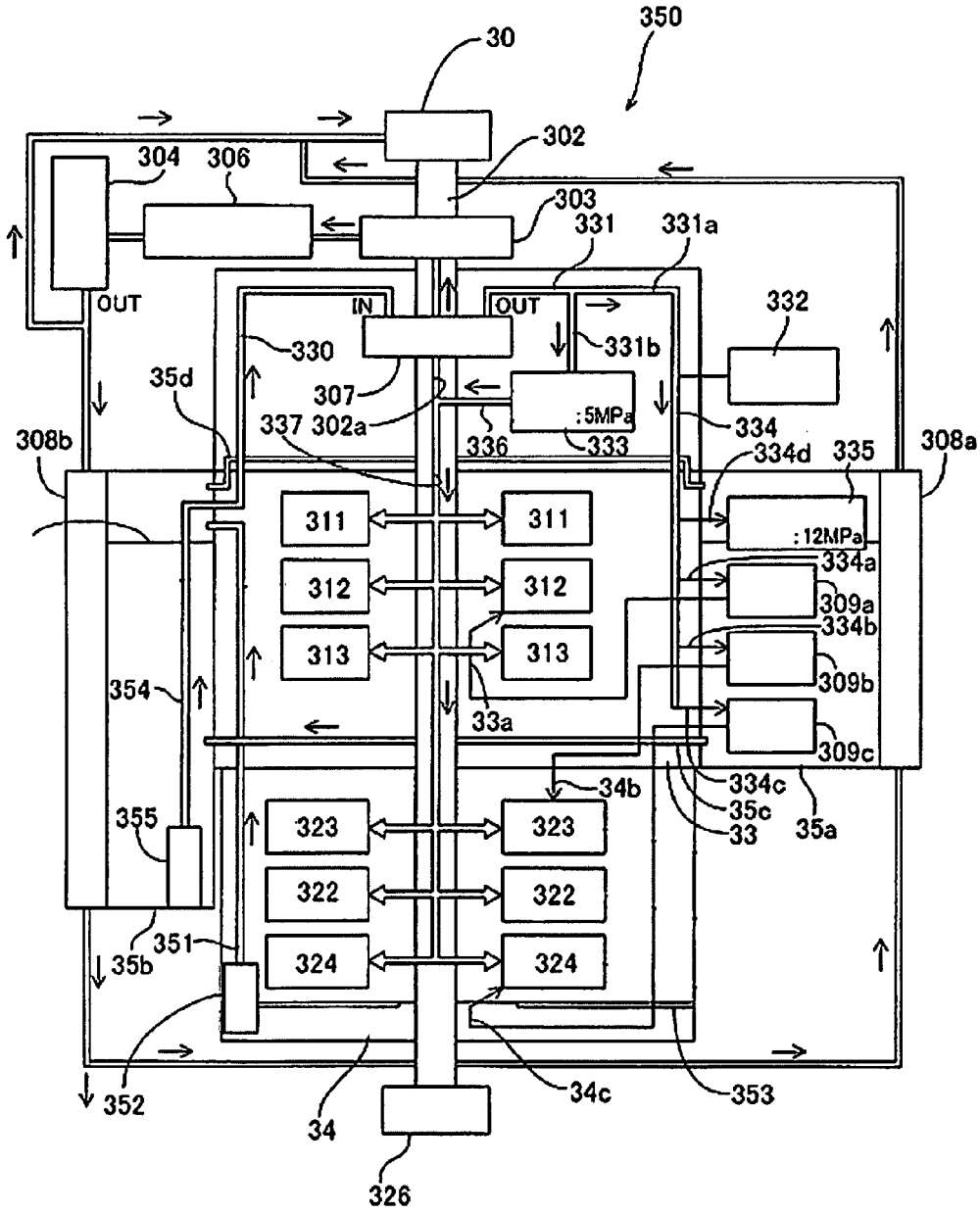
FIG. 5 is a drawing explaining the configuration of an oil lubrication route of an outboard motor according to a second preferred embodiment of the present invention.

FIG. 5 is a drawing explaining the configuration of an oil lubrication route of an outboard motor according to the second preferred embodiment of the present invention. Hereinafter, with reference to FIG. 5, the configuration of the outboard motor according to the second preferred embodiment of the present invention will be explained in detail. This second preferred embodiment describes an example of a configuration in which the oil retained in the lower housing 34 is suctioned to the oil tanks 35*a* and 35*b* without providing an oil pump that suctions the oil retained in the lower housing 34 to the oil tanks 35*a* and 35*b*, unlike the first preferred embodiment.

As shown in FIG. 5, in the second preferred embodiment, since the oil pump that suctions the oil retained in the lower housing 34 to the oil tanks 35*a* and 35*b* is not provided, unlike in the first preferred embodiment, the upper variable speed portion 310 does not include a spur gear arranged to drive the oil pump.

An inner portion of the upper housing 33, an inner portion of the lower housing 34, an inner portion of the oil tank 35*a*, and an inner portion of the oil tank 35*b* each maintains a sealed state from the outside. That is, the upper housing 33, the lower housing 34, the oil tank 35*a*, and the oil tank 35*b* are each configured to prevent leakage of the oil and air from the inner portion thereof.

Next, the configuration of an oil lubrication route 350 of the outboard motor according to the second preferred embodiment will be explained.

An oil route 351 is disposed between the lower portion of the lower housing 34 and the upper portion of the oil tank 35*b*. One side of a check valve 352 is mounted on one end of the oil route 351. The check valve 352 is mounted so that the other side of the check valve 352 is positioned below the level of the oil that is retained in the lower portion of the lower housing 34 after lubricating each portion in the upper housing 33 and the lower housing 34. More specifically, the other side of the check valve 352 is mounted below a baffle plate 353 arranged to inhibit the oil from splashing upward. Moreover, the other end of the oil route 351 is connected with the upper portion of the oil tank 35*b*.

One side of an oil route 354 is disposed on the lower portion of the oil tank 35*b*. A filter 355 is mounted on the one side of the oil route 354. The filter 355 has a function of filtering waste, dust, etc. in the oil when the oil retained in the oil tanks 35*a* and 35*b* is suctioned from the one side of the oil route 354.

By configuring the oil lubrication route 350 as described above, the pressures in the oil tanks 35*a* and 35*b* become negative in accordance with the reduction of the oil in the oil tanks 35*a* and 35*b* when the oil retained in the oil tanks 35*a* and 35*b* is suctioned by the oil pump 307. Consequently, the oil retained in the lower housing 34 is suctioned through the oil route 351. Then, the oil suctioned to the oil route 351 is allowed to flow into the oil tanks 35*a* and 35*b*. In addition, by providing the check valve 352, the oil suctioned by the oil route 351 is prevented from returning to the lower housing 34, so that the oil level in the oil route 351 can be maintained high. This enables smooth oil flow from the oil route 351 into the oil tanks 35*a* and 35*b* even when the pressure in the oil tanks 35*a* and 35*b* does not become substantially negative.

The other configurations of the second preferred embodiment are the same as those of the first preferred embodiment, and so an explanation thereof is omitted.

Moreover, the results of the second preferred embodiment are substantially the same as that of the first preferred embodiment.

Third Preferred Embodiment

Figure 6:
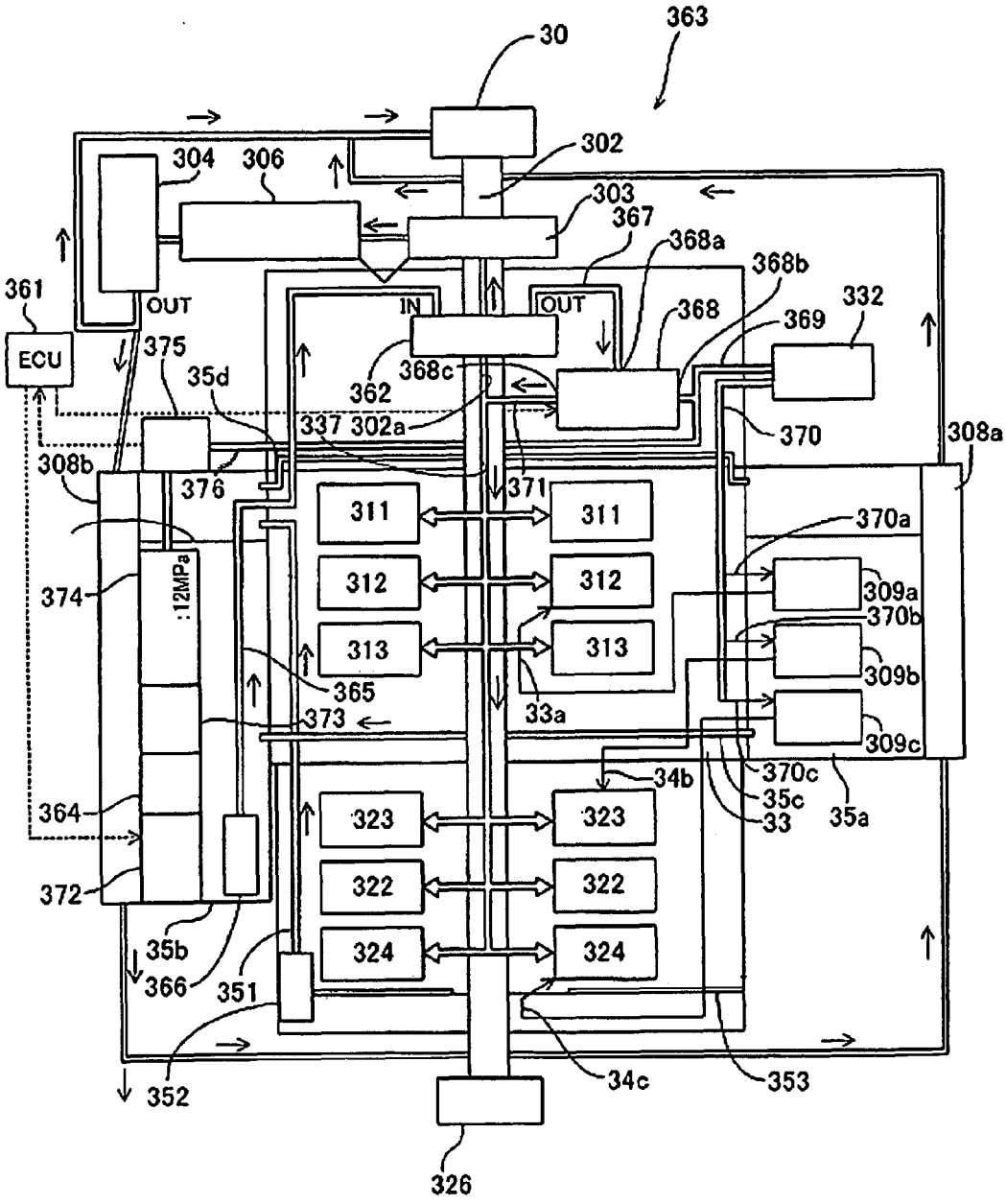
FIG. 6 is a drawing explaining the configuration of the oil lubrication route of the outboard motor according to a third preferred embodiment of the present invention.

FIG. 6 is a drawing explaining the configuration of an oil lubrication route of an outboard motor according to the third preferred embodiment of the present invention. Hereinafter, with reference to FIG. 6, the configuration of the outboard motor according to the third preferred embodiment of the present invention will be explained in detail. In this third preferred embodiment, a description will be made with respect to an example in which two oil pumps which are an oil pump 364 that supplies oil to the solenoid valves 309*a*, 309*b*, and 309*c* and an oil pump 362 that supplies the oil to the variable speed mechanism portion 32 are provided, unlike the first and second preferred embodiments.

As shown in FIG. 6, an ECU (Engine Control Unit) 361 arranged to control the rotation speed of the engine 30, the gear shift timing of the variable speed mechanism portion 32, and the like is provided on the outboard motor according to the third preferred embodiment of the present invention. The ECU 361 is connected with an emergency valve 368, a motor 372, and an oil pressure sensor 375 described below and has a function of controlling the emergency valve 368, the motor 372, and the oil pressure sensor 375 described below.

An oil pump 362 preferably defined by a trochoid pump is mounted below the bevel gear 303 of the drive shaft 302. It should be noted that the oil pump 362 is an example of "a third oil pump" according to a preferred embodiment of the present invention. The oil pump 362 is configured to be operated in accordance with the rotation of the drive shaft 302. The oil pump 362 also has a function of suctioning the oil retained in the oil tanks 35*a* and 35*b* as well as applying hydraulic pressure to the oil to supply the suctioned oil to a specified portion (the variable speed mechanism portion 32) in the outboard motor according to the third preferred embodiment of the present invention.

In the third preferred embodiment, since an oil pump that suctions the oil retained in the lower housing 34 to the oil tanks 35*a* and 35*b* is not provided like the second preferred embodiment, the upper variable speed portion 310 does not include the spur gear arranged to drive an oil pump.

The inner portion of the upper housing 33, the inner portion of the lower housing 34, the inner portion of the oil tank 35*a*, and the inner portion of the oil tank 35*b* each maintains a sealed state from the outside. That is, the upper housing 33, the lower housing 34, the oil tank 35*a*, and the oil tank 35*b* are each configured to prevent leakage of the oil and air from the inner portion thereof.

Next, the configuration of an oil lubrication route 363 of the outboard motor according to the third preferred embodiment will be explained.

The oil lubrication route 363 includes a route in which the oil retained in the pair of oil tanks 35*a* and 35*b* flows into the oil pump 362 and then the oil is supplied to the upper housing 33 and the lower housing 34, and a route in which the oil retained in the pair of oil tanks 35*a* and 35*b* is supplied to the solenoid valves 309*a*, 309*b*, and 309*c* by the oil pump 364 provided in the oil tank 35*b*. It should be noted that the oil pump 364 is an example of "a fourth oil pump" according to a preferred embodiment of the present invention. Moreover, the oil lubrication route 363 includes a route arranged to return the oil supplied to the upper housing 33 and the lower housing 34 to the pair of oil tanks 35*a* and 35*b*.

Initially, a route of the oil to be suctioned by the oil pump 362 will be explained.

One side of an oil route 365 is disposed in the inner portion of the oil tank 35*b*. A filter 366 is mounted on the one side of the oil route 365. The filter 366 has a function of filtering waste, dust, etc. in the oil when the oil retained in the oil tanks 35*a* and 35*b* is suctioned from the one side of oil route 365. The other side of the oil route 365 is connected with the oil pump 362. The oil route 365 is provided to allow the oil retained in the oil tank 35*b* (oil tank 35*a*) to flow into the oil pump 362.

Moreover, one side of an oil route 367 arranged to guide the oil flowing from the oil tank 35*b* (oil tank 35*a*) is connected with the oil pump 362. The other side of the oil route 367 is connected with an oil inlet port 368*a* of the emergency valve 368. The emergency valve 368 includes two guiding ports, which are a solenoid side guiding port 368*b* and a housing side guiding port 368*c* arranged to guide the oil flowing into the emergency valve 368. It should be noted that the emergency valve 368 is an example of "a valve member" according to a preferred embodiment of the present invention.

One side of an oil route 369 is connected with the solenoid side guiding port 368*b*, and the other side of the oil route 369 is connected with the filter 332. The filter 332 has a function of filtering waste, dust, etc. in the oil flowing to the solenoid valves 309*a*, 309*b*, and 309*c*. The filter 332 also has a function of preventing the pressure of the oil guided from the oil pump 362 from increasing.

One side of an oil route 370 arranged to guide the oil flowing from the solenoid side guiding port 368*b* or the oil pump 364 is connected with the filter 332. The other side of the oil route 370 is divided into a first solenoid route 370*a* connected with the solenoid valve 309*a*, a second solenoid route 370*b* connected with the solenoid valve 309*b*, and a third solenoid route 370*c* connected with the solenoid valve 309*c*.

In addition, one side of an oil route 371 is connected with the housing side guiding port 368*c*, and the other side of the oil route 371 is connected with the oil route 302*a* provided on the axis of the drive shaft 302.

In the third preferred embodiment, the emergency valve 368 is generally configured so that only the housing side guiding port 368*c* is opened. That is, the oil suctioned by the oil pump 364 is supplied only to the variable speed mechanism portion 32 in a normal state and not supplied to the solenoid valves 309*a*, 309*b*, and 309*c*. In addition, the solenoid side guiding port 368*b* is configured to be opened by the instruction of the ECU 361 when the ECU 361 determines that the output of the oil pump 364 becomes lower than a specified output by the oil pressure sensor 375 described below. That is, the emergency valve 368 is configured to distribute the oil to be supplied to the variable speed mechanism portion 32 to the solenoid valves 309*a*, 309*b*, and 309*c*.

Next, a route of the oil suctioned by the oil pump 364 will be explained.

The oil pump 364 arranged to guide the oil retained in the oil tank 35*b* (oil tank 35*a*) from the oil tank 35*b* is disposed in the oil tank 35*b*. The oil pump 364 is configured to be operated by the motor 372. The motor 372 is configured to be driven by the ECU 361.

A check valve 373 is connected with the oil pump 364, and a high-pressure relief valve 374 is connected with the check valve 373. The high-pressure relief valve 374 has a function of discharging oil from a relief valve (not shown) of the high-pressure relief valve 374 when the pressure of the oil guided from the oil pump 364 increases to reach approximately 12 MPa or more. Additionally, the oil discharged from the high-pressure relief valve 374 is discarded in the oil tank 35*b*.

The high-pressure relief valve 374 is connected with the oil pressure sensor 375. The oil pressure sensor 375 has a function of detecting the pressure of the oil guided from the oil pump 364. Additionally, the oil pressure data detected by the oil pressure sensor 375 is converted into an electric signal and transmitted to the ECU 361, and the ECU 361 determines whether or not the oil pressure data detected by the oil pressure sensor 375 is within a specified pressure range. Moreover, one side of an oil route 376 is connected with the oil pressure sensor 375, and the other side of the oil route 376 is connected with the oil route 369. That is, the oil pressure sensor 375 is connected with the filter 332.

Additionally, the other configurations of the third preferred embodiment are the same as those of the second preferred embodiment, so that explanation thereof is omitted.

As described above, in the third preferred embodiment, there are provided the oil pump 362 that supplies the oil retained in the oil tank 35*b* to the variable speed mechanism portion 32 (the upper housing 33 and the lower housing 34), the oil pump 364 that supplies the oil retained in the oil tank 35*b* to the solenoid valves 309*a*, 309*b*, and 309*c*, and the emergency valve 368 that distributes the oil suctioned by the oil pump 362 to the solenoid valves 309*a*, 309*b*, and 309*c* when the output of the oil pump 364 is decreased. This allows the oil pump 362 to supply the oil to the solenoid valves 309*a*, 309*b*, and 309*c* since the solenoid side guiding port 368*b* of the emergency valve 368 is opened even when the output of the oil pump 364 is decreased as the output of the motor 372 is decreased.

It should be understood that the preferred embodiments disclosed herein are exemplary in all aspects and not limiting. The scope of the present invention is shown not by the explanation of the above-described preferred embodiments but by the claims, and further, it includes all modifications in the meaning and scope that are equivalent to the scope of the claims.

For example, in the above preferred embodiments, as an example of the boat propulsion unit, an example including two outboard motors in which the engine and the propellers are disposed on the outside of the hull is shown. However, the present invention is not limited to this, and is applicable to other boat propulsion units including a stern drive in which an engine is fixed to a hull and an inboard motor in which an engine and a propeller are fixed to a hull, for example.

In the above preferred embodiments, an example of the outboard motor having two propellers is shown. However, the present invention is not limited to this. The outboard motor may include one propeller, three propellers, or more.

The above preferred embodiments show an example of the oil tanks provided one by one on the right and left sides of a plane that includes the axis of the drive shaft and extends in the moving direction of the boat. However, the present invention is not limited to this, and two oil tanks may be provided on only one of the right and left sides of the plane that includes the axis of the drive shaft and extends in the moving direction of the boat. Moreover, the oil tanks may be provided one by one on the front and rear sides of the drive shaft. Alternatively, only one oil tank may be provided.

In the above preferred embodiments, an example in which the pair of oil tanks is connected and the oil retained in the pair of oil tanks is supplied to both the upper housing and the lower housing is shown. However, the present invention is not limited to this, and in a state that the pair of oil tanks are not connected, the oil retained in one oil tank may be supplied to the upper housing while the oil retained in the other oil tank may be supplied to the lower housing. That is, the oil tank that retains the oil to be supplied to the upper housing and the oil tank that retains the oil to be supplied to the lower housing may be independently provided.

In the above preferred embodiments, an example of the oil tank provided separately from the upper housing is shown. However, the present invention is not limited to this. The oil tank and the upper housing may be integrally provided.

In the above preferred embodiments, an example of the cooling water distribution tank that is disposed to cover the sides of the oil tank in the U-letter shape is shown. However, the present invention is not limited to this. The cooling water distribution tank may be disposed to cover at least one surface of the oil tank.

In the first preferred embodiment, an example of the oil pump 338 configured to operate in accordance with the rotation of the spur gear is shown. However, the present invention is not limited to this. The oil pump 338 may be driven by other driving sources such as a motor.

In the third preferred embodiment, an example of the oil pump 364 driven by the motor is shown. However, the present invention is not limited to this. The oil pump 364 may be driven by a driving source other than the motor, for example, in accordance with the rotation of the drive shaft.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat propulsion unit comprising:

an engine;

a propeller driven by the engine;

a variable speed mechanism portion arranged to transmit a driving force generated by the engine to the propeller such that a speed of the driving force is changed by at least a low reduction ratio and a high reduction ratio;

a first housing arranged to house the variable speed mechanism portion;

an oil tank provided on an outside of the first housing and arranged to retain oil to be supplied to the first housing; and an oil lubrication route arranged to supply oil in the oil tank to the first housing and to collect the oil supplied to the first housing in the oil tank; wherein the engine includes a drive shaft arranged to transmit a driving force, and the oil tank is disposed on at least one of two areas separated by a plane that includes an axis of the drive shaft and extends in a moving direction of a boat.

2. The boat propulsion unit according to claim 1, further comprising:

an exhaust expansion chamber arranged to distribute exhaust gas discharged from the engine; and a case portion arranged to house the exhaust expansion chamber, the first housing, and the oil tank; wherein the first housing is disposed in front of the exhaust expansion chamber;

the oil tank includes a pair of oil tanks; and the pair of oil tanks is respectively disposed on at least one of the right and left sides of the first housing.

3. The boat propulsion unit according to claim 1, wherein the oil tank includes a pair of oil tanks, and the pair of oil tanks are separately disposed on the right and left sides of the first housing.

4. A boat propulsion unit comprising:

an engine;

a propeller driven by the engine;

a variable speed mechanism portion arranged to transmit a driving force generated by the engine to the propeller such that a speed of the driving force is changed by at least a low reduction ratio and a high reduction ratio;

a first housing arranged to house the variable speed mechanism portion;

an oil tank provided on an outside of the first housing and arranged to retain oil to be supplied to the first housing;

an oil lubrication route arranged to supply oil in the oil tank to the first housing and to collect the oil supplied to the first housing in the oil tank; and a second housing disposed adjacent to a portion above or below the first housing and arranged to house a shift mechanism portion that is provided in the variable speed mechanism portion and switches between forward and backward movements; wherein the oil lubrication route is arranged to supply oil in the oil tank to the first and second housings and to collect the oil supplied to the first and second housings in the oil tank.

5. The boat propulsion unit according to claim 4, wherein the oil tank is mounted on an outer wall of one of the first housing and the second housing, and the second housing is disposed above the first housing.

6. The boat propulsion unit according to claim 4, further comprising a first oil pump provided in the second housing and arranged to collect oil supplied in the first housing and the second housing in the oil tank.

7. The boat propulsion unit according to claim 6, further comprising a gear provided in the first housing to be rotatable in accordance with the rotation of the drive shaft, wherein the first oil pump is driven in accordance with the rotation of the gear.

8. A boat propulsion unit comprising:

an engine;

a propeller driven by the engine;

a variable speed mechanism portion arranged to transmit a driving force generated by the engine to the propeller such that a speed of the driving force is changed by at least a low reduction ratio and a high reduction ratio;

a first housing arranged to house the variable speed mechanism portion;

an oil tank provided on an outside of the first housing and arranged to retain oil to be supplied to the first housing; and an oil lubrication route arranged to supply oil in the oil tank to the first housing and to collect the oil supplied to the first housing in the oil tank; wherein the oil tank is mounted on an outer wall of the first housing.

9. A boat propulsion unit comprising:

an engine;

a propeller driven by the engine;

a variable speed mechanism portion arranged to transmit a driving force generated by the engine to the propeller such that a speed of the driving force is changed by at least a low reduction ratio and a high reduction ratio;

a first housing arranged to house the variable speed mechanism portion;

an oil tank provided on an outside of the first housing and arranged to retain oil to be supplied to the first housing;

an oil lubrication route arranged to supply oil in the oil tank to the first housing and to collect the oil supplied to the first housing in the oil tank; and an electromagnetic valve arranged to drive the variable speed mechanism portion, wherein the electromagnetic valve is disposed in the oil tank.

10. The boat propulsion unit according to claim 9, further comprising:

a first oil pump arranged to be driven in accordance with the rotation of the drive shaft, and to supply oil retained in the oil tank to at least the variable speed mechanism portion and the electromagnetic valve; and a relief valve arranged to cut off distribution to the variable speed mechanism portion and to supply oil to the electromagnetic valve when the output of the first oil pump is decreased.

11. The boat propulsion unit according to claim 9, further comprising:

a first oil pump arranged to be driven in accordance with the rotation of the drive shaft, and to supply oil retained in the oil tank at least to the variable speed mechanism portion;

a second oil pump arranged to be driven independently from the first oil pump to supply oil retained in the oil tank to the electromagnetic valve; and a valve member arranged to distribute oil pumped by the first oil pump to the electromagnetic valve when the output of the second oil pump is decreased.

12. The boat propulsion unit according to claim 1, wherein the oil tank includes a pair of oil tanks, and the boat propulsion unit further comprises an oil communication route that connects the pair of oil tanks and allows oil retained in each of the oil tanks to communicate with each other.

13. The boat propulsion unit according to claim 1, wherein the oil tank includes a pair of oil tanks, and the boat propulsion unit further comprises an air communication route arranged to connect upper portions of the pair of oil tanks with each other.

14. The boat propulsion unit according to claim 1, further comprising a cooling water distribution tank arranged to cover a lateral side of the oil tank and arranged to distribute cooling water.

* * * * *